United States Patent [19]

Haas

[11] 4,235,407

[45] Nov. 25, 1980

[54] POT HANGERS

[76] Inventor: Thomas C. Haas, 2360 Vallejo St., San Jose, Calif. 94574

[21] Appl. No.: 15,891

[22] Filed: Feb. 28, 1979

[51] Int. Cl.[3] ..... A47H 1/10

[52] U.S. Cl. ..... 248/318; 47/67

[58] Field of Search ..... 248/318, 317; 211/113, 211/119; 220/92, 95; 47/67

[56] References Cited

U.S. PATENT DOCUMENTS

| | | | |
|---|---|---|---|
| 486,185 | 11/1892 | Sheets | 220/92 X |
| 792,905 | 6/1905 | Kirchner | 248/318 |
| 1,599,525 | 9/1926 | Hanson | 248/318 UX |
| 2,362,852 | 11/1944 | Spaulding | 220/92 |
| 2,365,099 | 2/1944 | O'Brien | 220/92 |
| 2,496,851 | 2/1950 | Bochau | 248/318 |
| 2,530,456 | 11/1950 | Fracchia | 47/67 X |
| 2,533,845 | 12/1950 | Stender | 248/318 |
| 2,950,840 | 8/1960 | Franz | 220/95 |
| 4,147,320 | 4/1979 | Biedebach | 47/67 X |

*Primary Examiner*—J. Franklin Foss

*Attorney, Agent, or Firm*—Thomas Schneck

[57] ABSTRACT

A pot hanger with downwardly extending pot clamping portions, the portions including a double hairpin bend section for engaging the upper rim of a pot collar, a thrust section extending angularly downward away from the double hairpin bend section for supporting a cantilever section extending from the thrust section back toward the double hairpin bend while simultaneously supporting the lower edge of the pot collar. The cantilever sections of opposed clamping portions face in opposite directions so that a pot may be braced against twisting and rotational forces.

13 Claims, 4 Drawing Figures

POT HANGERS

BACKGROUND OF THE INVENTION a. Field of the Invention

This invention relates generally to plant hangers and supports and more particularly to plant hangers adapted to suspend plastic flower pots or the like by the collar thereof.

b. Description of the Prior Art

Certain plants, usually of the "trailing" type, such as the Wandering Jew, are best potted within receptacles that can be hung or otherwise supported above the floor surface. This allows the plant to trail downwardly in a natural manner as it grows.

A flower pot or similar receptacle is most easily suspended by any of the commercially available pot hangers. A first major category of hangers includes those having a base portion for supporting a flower pot from beneath and a number of support lines upwardly extending from the base portion for attachment to a hanging hook or ring. Examples of hangers falling into this first category would be macrame hangers which are usually made by knotting jute or other fibrous materials into a desired structure.

A second category of hangers includes those having a plurality of suspension arms which terminate in a hook at one end and which have their free ends adapted to engage holes or apertures formed in the sides or bottom of a plant pot. Examples of plant hangers falling into this category are described in U.S. Pat. Nos. 3,943,661 of DeVito et al., and 3,981,099 of Dziewulski.

While plant pot hangers falling within the first two categories can be constructed so as to be aesthetically pleasing or even beautiful, virtually all such hangers include more materials, and perhaps labor, than necessary to do the job. For example, while a macrame pot hanger may be a work of art, it is usually laboriously hand crafted. Hangers which engage apertures formed in the plant pot either require custom-made pots or they require that existing pots be modified so as to be usable with that particular type of hanger.

A third, and usually least expensive, category of plant hangers includes those hangers formed from a single continuous length of wire which have a hook portion, a pair of downwardly extending suspension arm portions, and a pair of clamping portions formed at the end of the arm portions for engaging the collar of a pot. Such hangers can be formed from inexpensive materials, such as twelve-guage mild steel, and typically cost only pennies apiece to produce. Because of their low cost, they, along with an associated plastic plant pot, can be distributed with the sale of a plant.

The clamping portions of prior art hangers of the third category have several problems, a first being that the clamping portions may not firmly engage the collar of the pot and thus may lose their grip under adverse conditions. Another problem is that the clamping portions usually require intricate wire bending to effectively form the clamping or support portions. This intricate wire bending, together with extra amounts of wire which may be needed in the course of manufacturing many thousands of plant pot hangers, can represent considerable sums of money.

A further disadvantage of prior art hangers of the third category is that their hook portions are formed perpendicular to their suspension arm portions which makes the hangers difficult to stack for compact storage.

SUMMARY OF THE INVENTION

It is an object of this invention to produce a pot hanger that is easy to manufacture, inexpensive, and effective.

A further object of this invention is to produce a pot hanger of the type belonging to the aforementioned third category which has clamping portions that will not loose their grip upon the collar of the plant pot even under adverse conditions.

Yet another object of this invention is to produce a pot hanger as described above which has clamping portions that use a minimal amount of wire formed in an effective manner.

Briefly, the pot hanger of this invention comprises a single, continuous length of wire bent near the middle to form a hook portion and two downwardly extending arm portions, the end of each arm portion being bent so as to form a pair of facing, spaced apart clamping portions adapted to clamp to the collar of a pot.

The clamping portions include a double hairpin bend section having an upwardly opening bend that is substantially closed and a downwardly opening bend which is sufficiently open to engage the upper rim of the collar, a thrust section spanning the width of the collar and a cantilever section which is adapted to support a lower rim of the collar. The two spaced apart thrust sections in respective clamping portions extend angularly downwardly in opposite directions relative to each other, but in circumferential alignment with a pot collar to be supported. From the downward ends of the thrust sections, cantilever arms extend horizontally in opposite directions relative to each other, slightly inwardly of said thrust sections, supporting the lower rim of a flower pot collar so as to brace the pot against twisting and rotational forces.

DETAILED DESCRIPTION OF A PREFERRED EMBODIMENT

Figure 1:
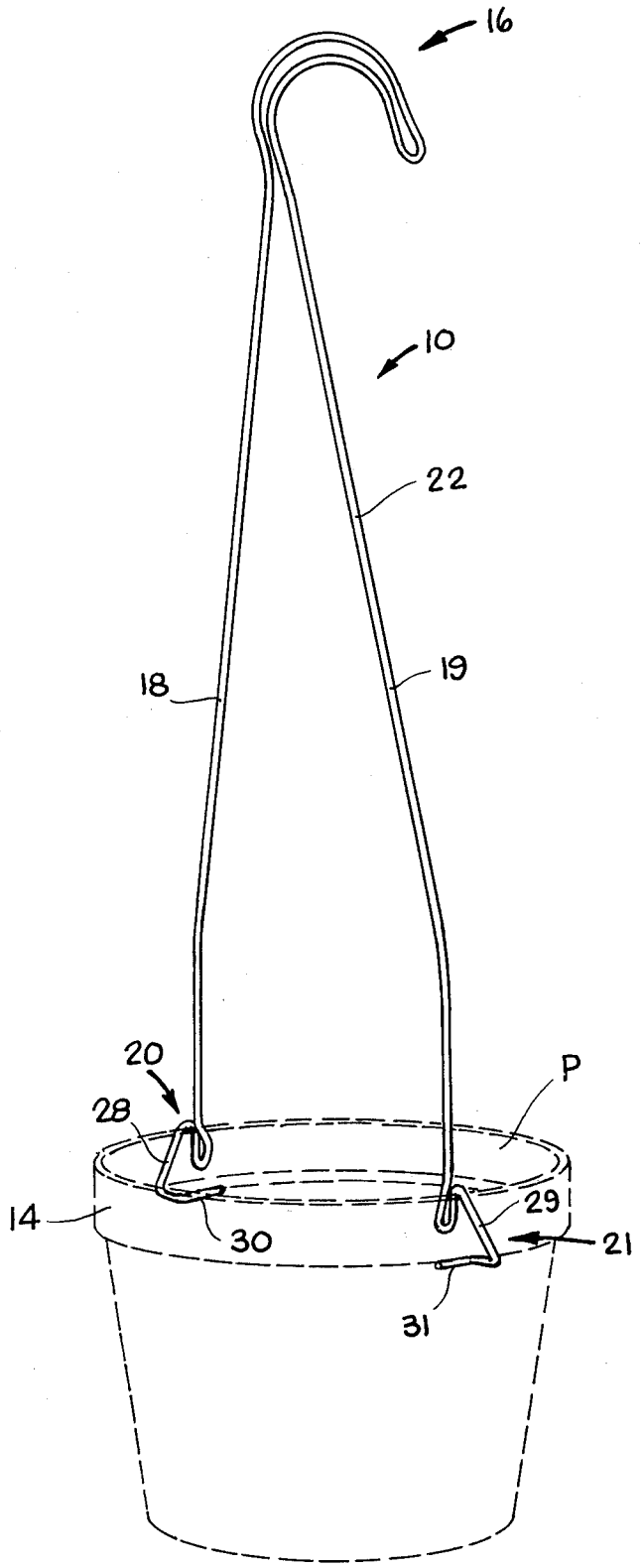
FIG. 1 is a perspective view of a pot hanger in accord with the present invention.

Referring to FIG. 1, a pot hanger 10 in accord with the present invention is shown to be attached to a plastic flower pot P, shown here by phantom lines, having a collar 14. The pot hanger itself includes a hook portion 16, a pair of suspension arm portions 18, 19 and a pair of spaced apart, mutually facing, clamping portions 20, 21 extending from respective downward ends of the suspension arm portions. The hook portion, suspension arm portions, and clamping portions are formed from a single, continuous length of wire, such as twelve-gauge mild steel, and can be manufactured with a "multi-operation" customized wire forming machine.

Figure 2:
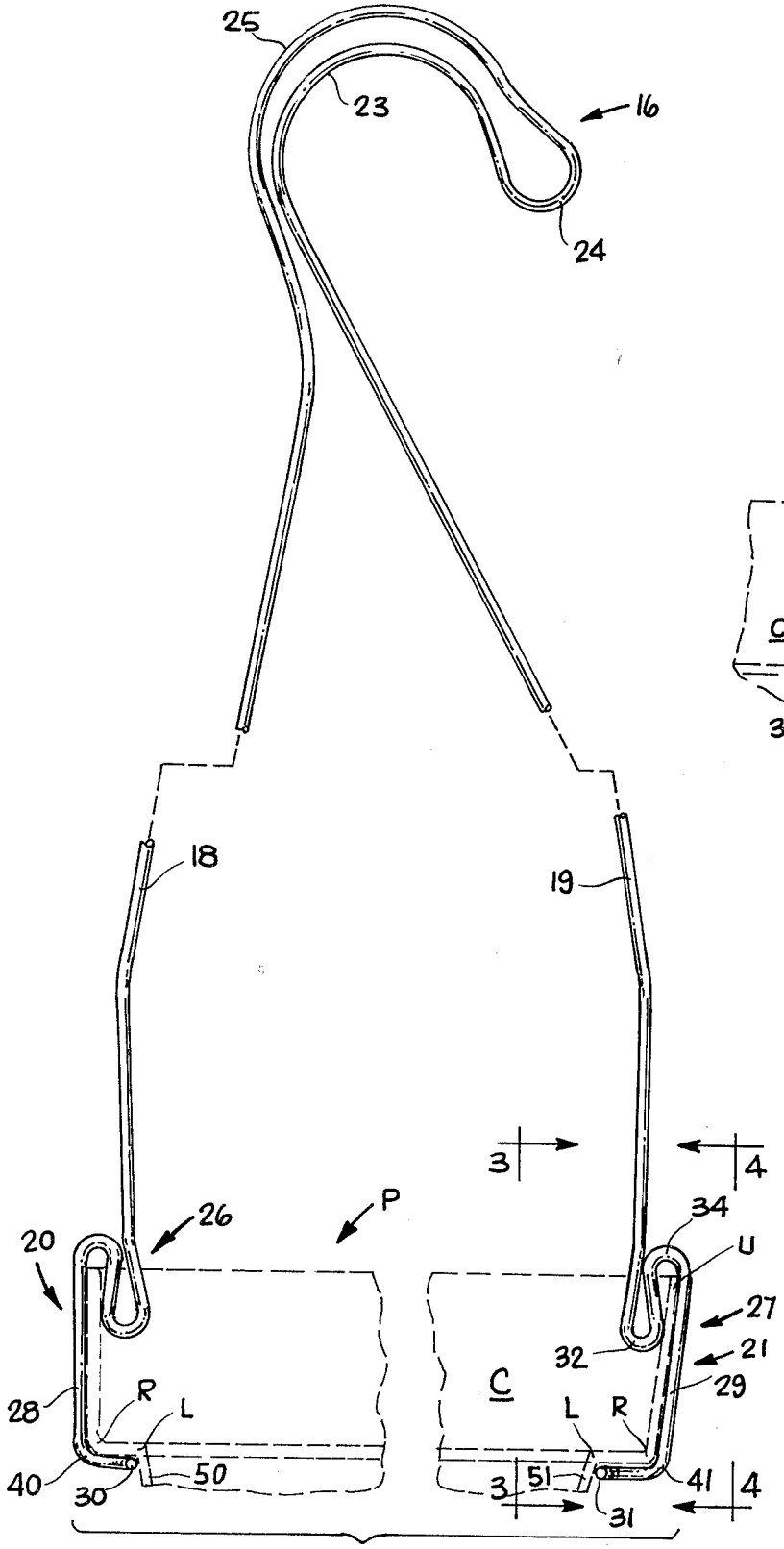
FIG. 2 is a side elevational view of the hanger shown in FIG. 1.

Referring to the side view of FIG. 2, hook portion 16 can be seen to be formed proximate the mid length of the hanger by bending a portion of the wire into an open loop.

Hook portion 16 is positioned such that the clamping portions 20, 21 are at equal downward distances from the top of the hook so that the collar of the pot will be approximately level when the hook is hung on a transverse rod, bar or similar horizontal member. The end 24 of hook portion 16 is slightly off center from the center of the single length of wire from which the hanger is formed. This is in order to allow for a longer length of wire to accommodate the outer curved section 25 relative to the inner curved section 23, both of which form hook portion 16. Certainly there are other ways in which the hook portion may be formed, the advantage of the present construction being that the inner curved section 23 and the outer curved section 25 may lie in the same plane as suspension arm portions 18, 19. The end 24 of the hook portion is made to be slightly bulbous so as to inhibit the hook portion from sliding off or otherwise disengaging from a transverse support member.

Suspension arm portions 18, 19 are shown to divergingly extend from the hook portion until they are separated at their downward ends by approximately the diameter of the upper rim of collar C. The suspension arm portions might diverge to a lesser or greater extent than that diameter but may be pushed apart or pulled together to accommodate pots with collars of different diameters. Further, arm portions 18, 19 can be bent in various ways so as to produce aesthetically pleasing designs.

Clamping portions 20, 21 themselves include respective double hairpin bend sections 26, 27, thrust sections 28, 29 and cantilever sections 30, 31. The double hairpin bend section 27 includes a first upwardly opening bend 32 and a second, downwardly opening bend 34. The downward length of the first bend 32 is preferably less than the downward dimension of the collar C, although this is not necessary. First bend 32 is substantially closed while second bend 34 is open to a sufficient extent so as to be able to snugly engage the upper edge U of the collar 37 of pot 12. Double hairpin bend section 26 is similarly constructed. In this embodiment, the suspension arm portions, the hook portion, and the double hairpin bend section 26 of the clamping portions are substantially coplanar for ease of stacking, although such coplanar construction is not necessary. Connected to each of the double hairpin bend sections 26, 27 are the thrust sections 28 and 29 which extend downwardly therefrom and terminate in the respective cantilever sections 30, 31. It may be seen that the cantilever sections 30, 31 extend laterally inwardly from the thrust sections to be tangent to a flower pot region 50, 51 below collar 37. Each of the cantilever sections 30, 31 is connected to one of the thrust sections 28, 29 by a respective inward bend 40, 41 which places the cantilever sections mutually laterally inward with respect to each other relative to the thrust sections. In this position, the cantilever sections 30, 31 may support the lower rim R of collar C and in particular an inwardly extending lip L of the collar C. The inward curvature of the cantilever sections causes the clamping portions of the present invention to snap onto a flower pot collar with a snug fit. It is desirable that a flower pot collar have some elasticity so that the collar can be slightly bent in order to fit it into the downwardly opening bend and then fit a cantilever section beneath the collar. However, pot collar flexibility or resiliency is not required, since the clamping portion has some elasticity which allows it to be snapped around a pot collar.

Figure 3:
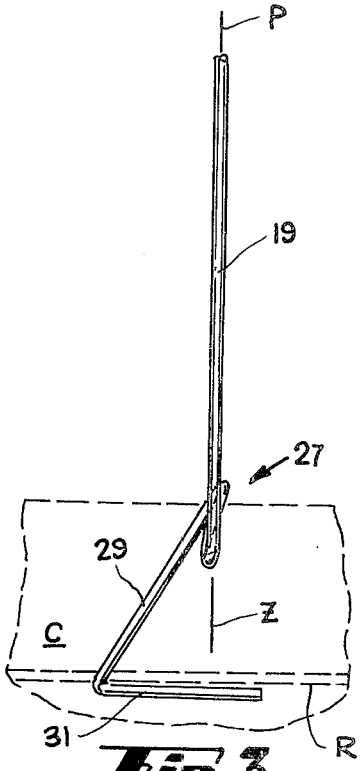
FIG. 3 is a view taken along line 3—3 of FIG. 2.
Figure 4:
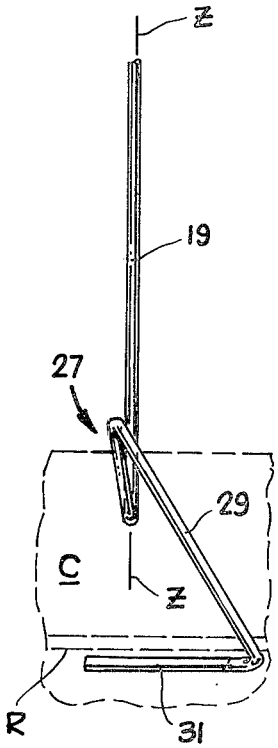
FIG. 4 is a view taken along line 4—4 of FIG. 2.

Referring additionally to the view shown in FIGS. 3 and 4, thrust section 29 can be seen to be bent in a first direction angularly downwardly relative to an imaginary plane, Z, defined by substantial parts of arm portions 18, 19. The two thrust sections 28, 29 are constructed the same, except that they extend downwardly in different directions relative to the imaginary plane, or alternately, from the double hairpin bend section. In FIGS. 3 and 4 it can be seen that the cantilever section 31 extends back from the lower end of thrust section 29 in a generally horizontal direction through the imaginary Z plane. The other cantilever section 30 on the opposite side of collar C, not shown in FIGS. 3 and 4, but visible in FIGS. 1 and 2 extends in the opposite horizontal direction. Cantilever sections 30, 31 engage the lower rim R, and in particular ledge L of the rim of the collar.

Referring again briefly to FIG. 1, it can be seen that the cantilever sections extend backwards from the thrust sections toward the double hairpin bend sections in mutually opposite directions along the lower ledge of the lower rim of collar C. It has been found that by angling the thrust sections mutually oppositely and directing the cantilever sections mutually oppositely as described, the grip of the clamping portions upon the pot collar becomes relatively immune to ordinary twisting or pulling forces which occur when watering a plant, picking flowers and foliage, or working the soil. The length and downward angle of each cantilever section may be adjusted to accommodate pots of different widths.

Clamping portions 26, 27 are bent and formed so that the various sections thereof cooperate to snugly engage the pot collar. For example, due to the shape of the clamping members, the cantilever sections are biased toward one another and slightly upwardly toward the lower edge of the rim to offset the expected weight of a pot. Also, as mentioned earlier, the second bend 34 allows entry of the upper edge of the rim. The cantilever sections may be laterally slightly rounded so as to conform to the circumferential curvature of a standard size pot below its collar to futher insure firm engagement with the collar thereof.

The principal improvement contemplated by the present invention is in the clamping portions of pot hangers. Existing pot hangers could be improved by taking any known hook or suspension means with any number of downwardly extending suspension arms and connecting clamping members of the present invention thereto. There is no reason to limit the number of clamping members to two, although that is the minimum number which would be needed.

What is claimed is:

1. A pot hanger for suspending a flower pot or the like having upper and lower collar rim edges comprising:

a single continuous length of wire having, an upper hook portion;

a pair of spaced apart suspension arm portions extending downwardly from said hook portion; and a pair of opposed, mutually facing clamping portions extending from respective free ends of said arm portions, each of said clamping portions including, (a) a double hairpin bend section having a first bend opening upwardly towards said hook portion and a second bend opening downwardly away from said hook portion, said second bend forming a loop admitting an upper rim of a pot collar, (b) a thrust section extending from said double hairpin bend section angularly downwardly and away from said double hairpin bend section, but in alignment with the exterior of a pot collar to be supported, (c) a cantilever section extending from the downward end of said thrust section back toward said double hairpin bend section, said cantilever section supporting the outside of the lower rim of a pot collar to be supported, each one of the opposed, mutually facing clamping portions having a cantilever section extending in a direction opposite the other, whereby a pot may be braced against twisting and rotational forces.

2. A pot hanger as recited in claim 1 wherein said hook portion is formed coplanar with at least a substantial part of said spaced apart arm portions.

3. A pot hanger as recited in claim 1 wherein said clamping portions are formed so that said first bend forms a substantially closed loop, and said loop of said second bend engages said upper rim of a pot collar to be supported.

4. A pot hanger as recited in claim 3 wherein the height of said first bend is less than the height of a pot collar to be supported.

5. A plant hanger as recited in claim 2 wherein said two thrust sections extend downwardly in opposite directions.

6. A pot hanger as recited in claim 6 wherein said clamping portions are formed wherein opposed cantilever sections extend in opposite directions with respect to each other from respective thrust sections.

7. A pot hanger as recited in claim 7 wherein said cantilever sections are rounded so as to conform with the circumferential curvature of said pot.

8. A pot hanger as recited in claim 1 wherein said cantilever sections are disposed mutually inwardly relative to said thrust sections beneath the lower rim of a pot collar to be supported.

9. In a wire pot hanger of the type having a suspension means and at least two downwardly extending suspension arms, an improvement in members adapted to support the collar of a pot comprising, mutually facing clamping members extending from respective free ends of suspension arms, each of said clamping members including, (a) a double hairpin bend section having a first bend opening upwardly and a second bend opening downwardly, said second bend forming a loop admitting an upper rim of a pot collar, (b) a thrust section extending from said double hairpin bend section angularly downwardly and away from said double hairpin bend section, but in alignment with the exterior of a pot collar to be supported, (c) a cantilever section extending from the downward end of said thrust section back toward said double hairpin bend section, said cantilever section supporting the outside of the lower rim of a pot collar to be supported, each one of the opposed, mutually facing clamping portions having a cantilever section extending in a direction opposite the other, whereby a pot may be braced against twisting and rotational forces.

10. A pot hanger as recited in claim 9 wherein said clamping portions are formed so that said first bend forms a substantially closed loop, and said loop of said second bend engages said upper rim of a pot collar to be supported.

11. A pot hanger as recited in claim 9 wherein the height of said first bend is less than the height of a pot collar to be supported.

12. A pot hanger as recited in claim 9 wherein said cantilever sections are rounded so as to conform with the circumferential curvature of said pot.

13. A pot hanger as recited in claim 9 wherein said cantilever sections are disposed inwardly relative to said thrust sections beneath the lower rim of a pot collar to be supported.

* * * * *

UNITED STATES PATENT AND TRADEMARK OFFICE

CERTIFICATE OF CORRECTION

PATENT NO. : 4,235,407

DATED : November 25, 1980

INVENTOR(S) : Thomas C. Haas

It is certified that error appears in the above-identified patent and that said Letters Patent are hereby corrected as shown below:

Address of inventor, "San Jose" should read --St. Helena--

Claim 6, Column 5, line 26, the term "claim 6" should read --claim 5--.

Claim 7, Column 5, line 30, the term "claim 7" should read --claim 6--.

Signed and Sealed this

Twelfth Day of May 1981

[SEAL]

*Attest:*

RENE D. TEGTMEYER

*Attesting Officer*

*Acting Commissioner of Patents and Trademarks*